United States Patent [19]

Riggs

[11] 4,235,028

[45] Nov. 25, 1980

[54] ORTHOTIC STABILIZER FOR ATHLETIC SHOE

[76] Inventor: Donnie E. Riggs, 1606 Monteval Ct., San Jose, Calif. 95120

[21] Appl. No.: 955,978

[22] Filed: Oct. 30, 1978

[51] Int. Cl.[2] ..... A43B 21/36

[52] U.S. Cl. ..... 36/80; 36/69

[58] Field of Search ..... 36/69, 80, 58.5, 58.6, 36/91, 92, 93, 104, 129, 28, 30 R

[56] References Cited

U.S. PATENT DOCUMENTS

| | | | |
|---|---|---|---|
| 1,575,490 | 3/1926 | Krech | 36/80 |
| 2,031,510 | 2/1936 | Stewart et al. | 36/80 |
| 2,260,377 | 10/1941 | Herbst | 36/80 |
| 3,333,353 | 8/1967 | Garcia | 36/69 |
| 4,137,654 | 2/1979 | Hlarac | 36/69 |

FOREIGN PATENT DOCUMENTS

| | | | |
|---|---|---|---|
| 895045 | 9/1953 | Fed. Rep. of Germany | 36/80 |

*Primary Examiner*—Patrick D. Lawson
*Attorney, Agent, or Firm*—Gerald L. Moore

[57] ABSTRACT

An orthotic stabilizer for an athletic shoe comprising a semirigid body formed to fit around and under the wearer's heel above the midsole forming a concave pocket for receiving the heel and extending from the heel along approximately two-thirds of the length of the foot. Immediately beneath the calcaneous region is an opening in the stabilizer approximately the size of the calcaneous lower extremity filled with a padding material. The stabilizer serves to cushion the calcaneous during running and expedite subtalar joint stabilization to allow the foot to accommodate to the running surface as heel contact is made.

6 Claims, 7 Drawing Figures

ORTHOTIC STABILIZER FOR ATHLETIC SHOE

BACKGROUND OF THE INVENTION

The normal motion of the foot in gait involves the periods of: (1) heel contact; (2) forefoot loading; (3) middle of midstance; (4) propulsion period; and (5) swing. During the period of heel contact it is necessary for the foot to absorb a significant shock and thereafter pronate to assume a firm contact with the running surface. The primary shock absorption occurs at the knee with a significant force being experienced in the calcaneous region of the heel.

Pronation of the foot is necessary to reduce shock as the weight is placed on the fatty pad of the calcaneous. The foot is dependent upon the subtalar joint, a universal type of joint connecting with the leg, to allow for transverse plane rotation by either eversion or inversion of the calcaneous, i.e. bending out or bending in of the leg after heel contact. Such contact pronation dampens the shock of the heel strike by the locking and unlocking of the foot joints. Pronation occurs from heel strike to full forefoot loading. Thereafter to propulsion supination occurs. The lifting of the lateral side of the foot acts to straighten out the force curve through the foot so that the final propulsion occurs through the hallux or the first metatarsal of the foot. Pronation of the foot is also responsible for proper flexing of the knee. Because the tibia must rotate faster than the femur in order to flex the knee, pronation must occur at a proper rate first for proper knee flexing.

Thus it can be seen that during running there is an initial heel shock which must be absorbed in the calcaneous region with ground contact. During running, and especially on uneven terrain or during turning, the foot is not always set down on a surface extending perpendicular to the leg thereby requiring pronation for accommodation with the running surface. Subsequent pronation is necessary for proper flexing of the knee. In each instance, however, the heel may receive the shock from a slightly different angle than through a force vector directly in line with the leg. In addition the fatty tissue beneath the calcaneous bears the brunt of the initial shock during heel contact and can present significant physical problems with sustained running exercises.

It is the purpose of the present invention to provide an orthotic stabilizer for incorporation in an athletic shoe to cushion the heel and prevent injury and to stabilize the foot during pronation.

DESCRIPTION OF THE INVENTION

Figure 1:
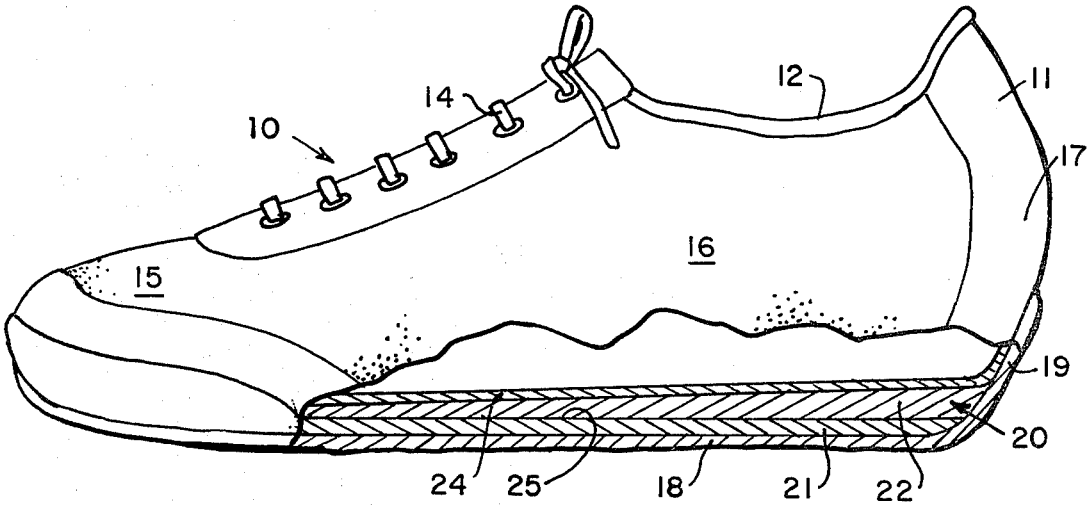
FIG. 1 is a side plan view of a jogging and training shoe of standard design.
Figure 3:
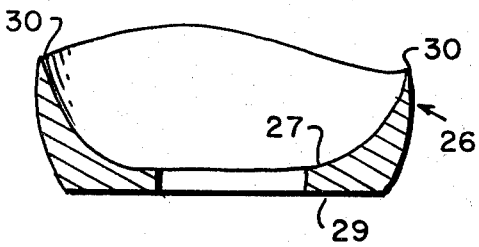
FIG. 3 is a cross-sectional view along the lines 3—3 of FIG. 2.
Figure 2:
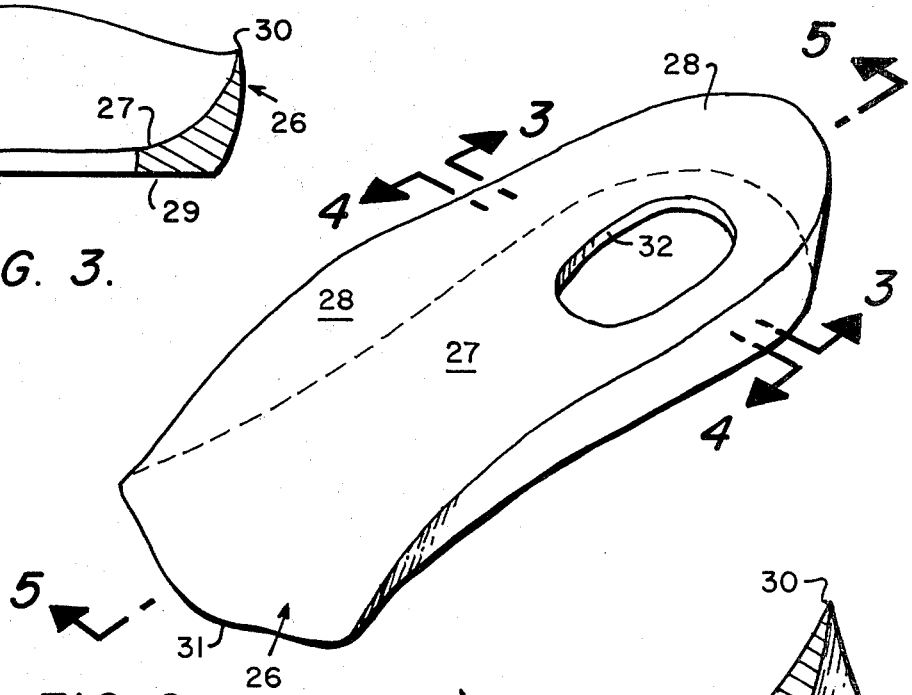
FIG. 2 is a perspective view of the orthotic stabilizer.
Figure 4:
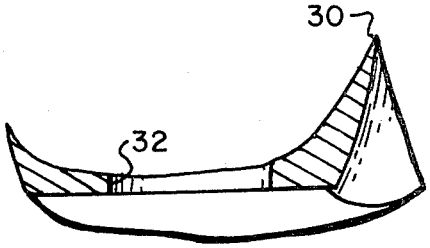
FIG. 4 is a cross-sectional view along the lines 4—4 of FIG. 3.
Figure 5:
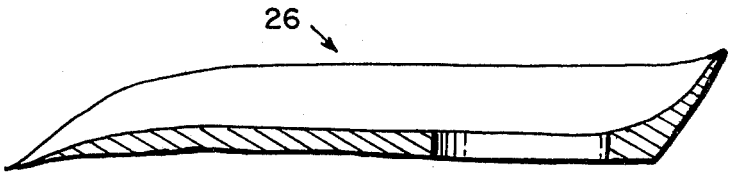
FIG. 5 is a cross-sectional view along the lines 5—5 of FIG. 2.

In FIG. 1 is shown a typical jogging and training shoe 10 having an upper portion 11 adapted to fit around the foot. The ankle extends through a top opening 12 which is partially closed by lacings 14. The shoe includes a toe portion 15, a midportion 16 and a heel portion 17. A wearing surface or sole 18 is provided having a heel counter 19.

The side of the shoe is cut away in the drawing to show a midsole 20 comprising two planar members 21 and 22 to which the wearing surface 18 is glued. In addition an inner sole 24 is glued to the top surface of the member 22. In the usual instance the midsole members 21 and 22 are made of a resilient material such as rubber so as to cushion the foot during impact with the running surface. Because of the need for greater cushioning in the heel, the heel portion of the midsole is usually made thicker. In addition the heel counter 19 extends up around the back portion of the shoe to cushion and protect the heel as it is set down during running. It has been the usual practice to utilize two or more planar members with adjacent surfaces glued together at the joint 25 to provide cushioning for the foot.

As pointed out before, the calcaneous region of the heel sustains substantial and repeated shocks during running especially on hard surfaces as are frequently encountered in jogging. The calcaneous is surrounded by a fatty tissue to absorb shock and protect the bone. The shoe as just described presents a flat surface formed by the resilient planar midsole for cushioning the foot. However the foot must rotate and swivel for proper knee and hip action. In addition during running, jogging or walking there is frequently encountered uneven terrain which results in placement of the heel on surfaces not extending perpendicular to the leg. Severe pressures can be exerted on the calcaneous region of the foot as swiveling of the foot and ankle immediately follows placement of the heel on such uneven surfaces. It is the primary purpose of the present invention to provide an orthotic appliance for protection of the calcaneous region of the foot in training and jogging shoes or the like.

Figure 6:
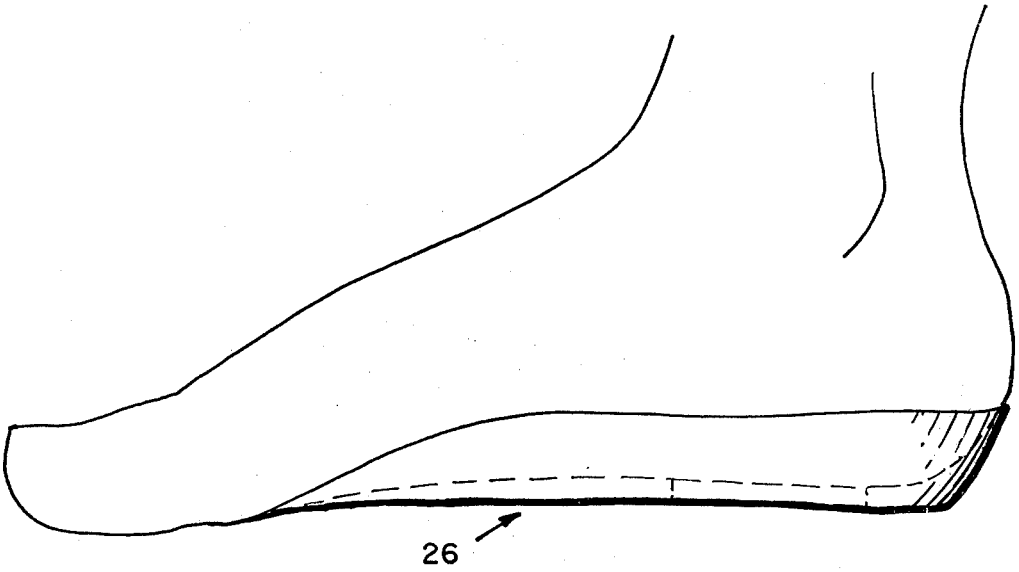
FIG. 6 is a side plan view of the foot in the orthotic stabilizer.

In accordance with the present invention, there is provided an orthotic stabilizer 26 which cradles the heel of the wearer and provides protection in the calcaneous region to guard against bruising and injuring of the foot by distributing and cushioning the shock forces exerted on the heel. The orthotic stabilizer comprises a body having a bottom surface 27 with an upwardly extending ridge or side edge 28 extending therearound terminating with upper edges and formed to fit closely about the heel of the foot as shown primarily in FIG. 6. In the preferred embodiment the stabilizer is made of a foamed plastic which is semirigid yet yielding under the weight of the foot and body. The bottom surface 29 is planar to conform with the top surface of the inner sole or midsole of a shoe. In addition the top or upper edges 30 of the sidewalls are narrowed down so as to present smooth transition between the stabilizer and the shoe side wall. Preferably this stabilizer is sized to fit the individual heel and extend forward therefrom approximately two-thirds the length of the foot to the metatarsal foot region and terminate there at a forward edge 31. At this forward edge and diverging rearward, the top and bottom surfaces form a medial wedge at which these surfaces diverge at approximately 4° from the forward section of the stabilizer to properly support the foot.

The orthotic stabilizer 26 must accommodate the various planes the foot experiences during gait. The stabilization of the midtarsal joint by the heel is extremely important when the foot is subjected to excessive frontal plane and transverse plane forces during early stance phase of gait. In the initial phase of gait during heel contact with the running or jogging surface, the heel must absorb shock, stabilize and then reinforce the foot through the subsequent phases of gait. During many types of running, the foot makes contact in the lateral midtarsal area initially with direct saggital plane force and proximal thrust towards the heel. This loading is then carried more distal-laterally and proximal medially to place the foot on the supporting surface. The orthotic stabilizer provides shock absorption during heel contact, stabilization of the calcaneous during pronation, deceleration of pronation and balance control of the forefoot during resupination.

The overall size of the device preferably is two-thirds the length of the foot from the ball to the heel (head of the metatarsal to the calcaneous). The medial edge of the device is elevated medially 2–8 millimeters depending on the individual's specific need. The wedge reduces from the calcaneous to the head of the metatarsal joint and tapers laterally between 5–25 degrees depending on the individual foot conformation.

In accordance with a further feature of the invention there is provided an aperture 32 in the center of the heel portion of the orthotic stabilizer beneath the calcaneous region of the heel. The opening allows for greater cushioning of the heel pad beneath the calcaneous while providing a more solid support for the region about the calcaneous. Such cushioning is provided by the midsole extending upwards through the opening as a downward force is exerted on the foot as occurs during heel contact. In this manner the shock resulting from ground contact being transmitted through the shoe to the heel is distributed more evenly throughout the calcaneous region to lessen the pressures on the foot immediately below the calcaneous and reduce the possibilities of bruises or injury.

The aperture preferably is egg-shaped with the apex positioned distal-laterally. It is centrally positioned in the heel seat of the device with the sides of the aperture being tapered from 5–25 degrees to allow for maximum stabilization and shock absorption. The heel area edge (seat) provides a support in a meniscal manner to the heel of the foot.

Thus it can be seen that the stabilizer cradles the heel and rear portion of the foot in a pliable body which extends up around sides of the heel. The heel is better protected by the stabilizer during those periods when the foot is set down on uneven surfaces requiring the foot to pivot sharply and align with the running surface. By providing the cushioning material immediately beneath the calcaneous and the semipliable material about the calcaneous, the forces impressed on the heel are more evenly distributed throughout the foot for greater comfort and less exposure to injury.

Figure 7:
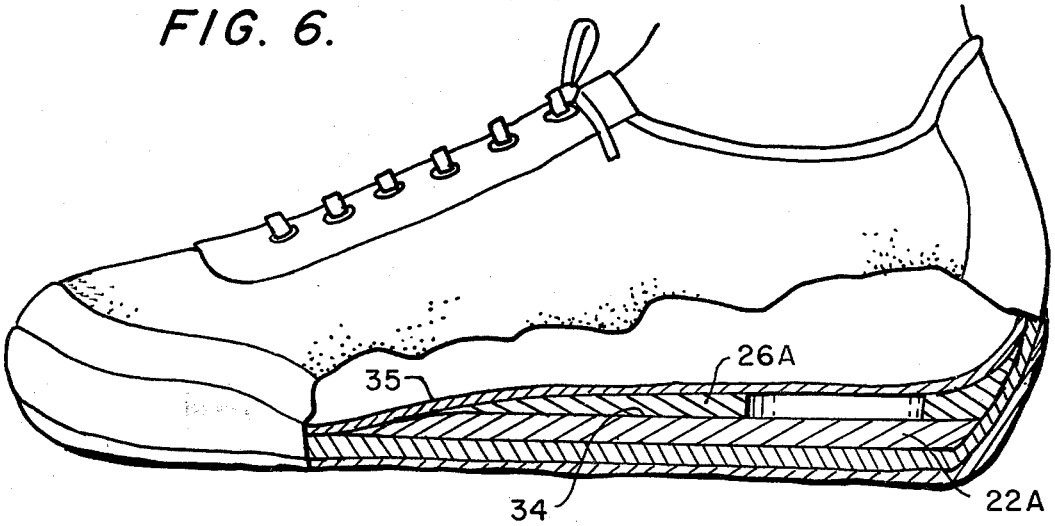
FIG. 7 is a side view, partially broken away, of a jogging and training shoe incorporating an orthotic stabilizer.

As explained previously the stabilizer thus serves to cradle and protect the heel against shock. The stabilizer can be made separate for insertion into a shoe already made or can be built into the shoe in the manner shown in FIG. 7. In this figure the stabilizer 26A is fixed directly to the midsole layer 22A by a glue joint 34 therebetween. Over the stabilizer is an innersole 35 extending the length of the shoe. Regardless of whether the stabilizer is separate or built into the shoe, it still cushions the heel of the foot in the same manner as previously described.

The Invention claimed:

1. In combination with a shoe having an upper portion having inner surfaces to receive the foot and a midsole; an orthotic stabilizer comprising:

a semi-pliable body having a concave upper surface formed to receive and cradle the heel and back two-thirds of the foot;

side edges fixed to said body extending upwards along the sides of the foot; and said side edges having outer surfaces formed to fit the inner surfaces of the shoe upper portion and terminating with upper edges;

said body having a bottom surface formed to fit the top surface of said midsole and including an aperture extending between the top and bottom surfaces and centered beneath the calcaneous region of the foot whereby said stabilizer will distribute the shock of running over the rear bottom and side portions of the foot.

2. The combination as defined in claim 1 wherein said upper edges are thin to form a smooth transition between the side edges and said adjacent shoe inner surfaces.

3. The combination as defined in claim 1 wherein the body includes a forward edge terminating in the metatarsal region of the foot.

4. The combination as defined in claim 3 wherein said forward edge is sufficently thin to form a smooth transition between the upper surface and the shoe midsole.

5. The method of cushioning the heel of the foot primarily during the heel contact phase of running, comprising the steps of:

positioning beneath the heel and the rear two-thirds of the foot a semi-rigid body having an upper surface formed to cradle the bottom of the foot and having side walls extending along the sides of the foot and heel and extending up along the sides of the foot sufficiently to prevent spreading of the foot during heel contact while running; and forming in the body an opening positioned immediately beneath the calcaneous region of the heel to reduce the shock exerted on the calcaneous region of the heel by holding the foot heel pad beneath the calcaneous region of the heel to distribute the shock to other portions of the foot.

6. A stabilizer for use with the human foot to release the shock encountered when the heel is set down on the ground, comprising in combination:

a semi-pliable body formed to fit beneath the back two-thirds of the foot and having a concave upper surface formed to receive and cradle the heel and foot and a bottom surface formed to fit within a shoe;

side edges attached to said body and positioned to fit up along the sides of the foot to enclose the heel and instep regions thereof;

said body including an aperture extending between the top and bottom surfaces and positioned beneath the calcaneous region of the foot whereby when the foot is set down during running or walking the aperture will receive the calcaneous region of the heel and the side walls will stabilize and hold the heel pad inward to assist in cushioning the heel region of the foot.

* * * * *